United States Patent [19]

Law

[11] Patent Number: 4,531,731

[45] Date of Patent: Jul. 30, 1985

[54] GYMNASTIC EQUIPMENT

[75] Inventor: Denny B. Law, San Marcos, Calif.

[73] Assignee: Unique Functional Products, San Marcos, Calif.

[21] Appl. No.: 569,278

[22] Filed: Jan. 9, 1984

[51] Int. Cl.[3] ..... A61H 1/02

[52] U.S. Cl. ..... 272/145; 272/144; 128/75; 128/71

[58] Field of Search ..... 128/57, 71, 70, 75, 128/74; 403/116, 117, 113; 16/360, 334, 348; 297/353, 354; 272/144, 145, 109; 16/346, 331, 361, 363, 356, 359, 377; 292/263

[56] References Cited

U.S. PATENT DOCUMENTS

| | | | |
|---|---|---|---|
| 2,228,793 | 1/1941 | Swofford | 272/144 |
| 3,568,669 | 3/1971 | Stites | 128/24 R |
| 3,685,511 | 8/1972 | Alvarez | 272/145 |
| 4,232,662 | 11/1980 | Barber | 128/71 |
| 4,438,761 | 3/1984 | McGowen | 128/71 |

*Primary Examiner*—Richard J. Apley
*Assistant Examiner*—James Prizant
*Attorney, Agent, or Firm*—Duane C. Bowen

[57] ABSTRACT

A body-supporting bed pivotally supported on a frame and juxtaposed circular plates controlling pivoting of the bed by a series of locking openings in a first plate, by a locking pin on a second plate, and by an abutment pin on a third plate disposed in arcuate slots in the first and second plates. A foot-supporting boom supported to extend an adjustable distance from the foot of the bed and a pair of adjustable spaced padded ankle-securing tubes on the end of the boom and a latch for the tubes including a push rod operated latch piece, the push rod having a knob disposed between the legs of the user.

28 Claims, 14 Drawing Figures

GYMNASTIC EQUIPMENT

BRIEF SUMMARY OF THE INVENTION

Background and Objectives

My invention relates to an improvement in gymnastic equipment of the type in which a user is supported on a bed which is pivotal backwardly to positions in which the user is partly or completely inverted and suspended from his feet or ankles.

This general type of product was termed "inversion equipment" in an article in Forbes, Sept. 26, 1983, page 122, entitled "The Upside-down Cure".

My invention is directed to various improvements over the prior art including the following:

(1) INCLINE POSITIONING

1. Positive incline limits settable at 15°, 30°, 45°, 60° and 95°.
2. Bed incline limits can be changed by the user while the user is on the unit.
3. Bed incline can be locked in park position while the user is adjusting ankle clamps.
4. Bed incline can be locked in 60° position for unit storage.
5. Bed incline can be padlocked in 60° position to prevent unauthorized use.
6. Park and inverted position stops incorporated in pivot mechanism. No cross bars to serve as obstacles to mounting and dismounting or to provide points where user (or bystander) hands get pinched.
7. Either of the two incline stop adjustment wheels can be used to set incline limit if the other wheel is set at 95°.
8. Park and 95° incline limits are protected by two stop pins, one in the left and one in the right incline stop setting disc assembly.
9. How an incline stop setting system works:

A center or intermediate disc or plate rotates by means of a hand wheel to the desired incline limit set point and a plunger in an outer disc or plate is released causing it to enter a hole in the center disc thus locking the center disc to the outer disc and preventing rotation of the center disc. A fixed pin in an inner disc moves in an arc-slot of the center disc until it strikes the end of this arc-slot thus stopping the bed rotation at that point. The angle of incline at that point will be as indicated on a control wheel at the plunger location. Stop limit load is applied to the plunger in the outer disc from the pin on the inner disc through the slot-end of the center disc through the center disc itself to the plunger hole in the center disc. In addition, the high stress positions, park and inverted, during sit-ups, are protected separately by the stop pin striking additional arc-slot ends in the outer discs. The safety factor of the incline stop system is approximately 5 at the unit rating limit of 300# and 6'6" tall.

(2) PIVOT MECHANISM

1. Brass bearings for smooth long life of rotating joint.
2. Take-up of bearing easily and precisely adjustable and lockable.

(3) ANKLE CLAMP MECHANISM

1. Remotely operable by a user without having to reach ankle area.
2. Fail safe mechanism remains locked when bed is in inclined positions, including inverted position, even if lock plunger spring were to be broken.
3. Clamp opens and closes instantly.
4. Soft contoured ankle pads for more comfort during prolonged use.

(4) FRAME

Clean neat frame lines uncluttered by cross members used to limit incline travel on other machines. Frame tubing is 22% stronger than that used in another unit on the market, for example.

Objectives of my invention include to devise gymnastic equipment having the foregoing improvements. Other objectives include to provide safe, easily operated, durable, economical gymnastic equipment and to devise such equipment particularly improved in the pivot control mechanism.

My invention will be best understood, together with additional advantages and objectives thereof, when read with reference to the drawings.

THE DRAWINGS

Figure 2:
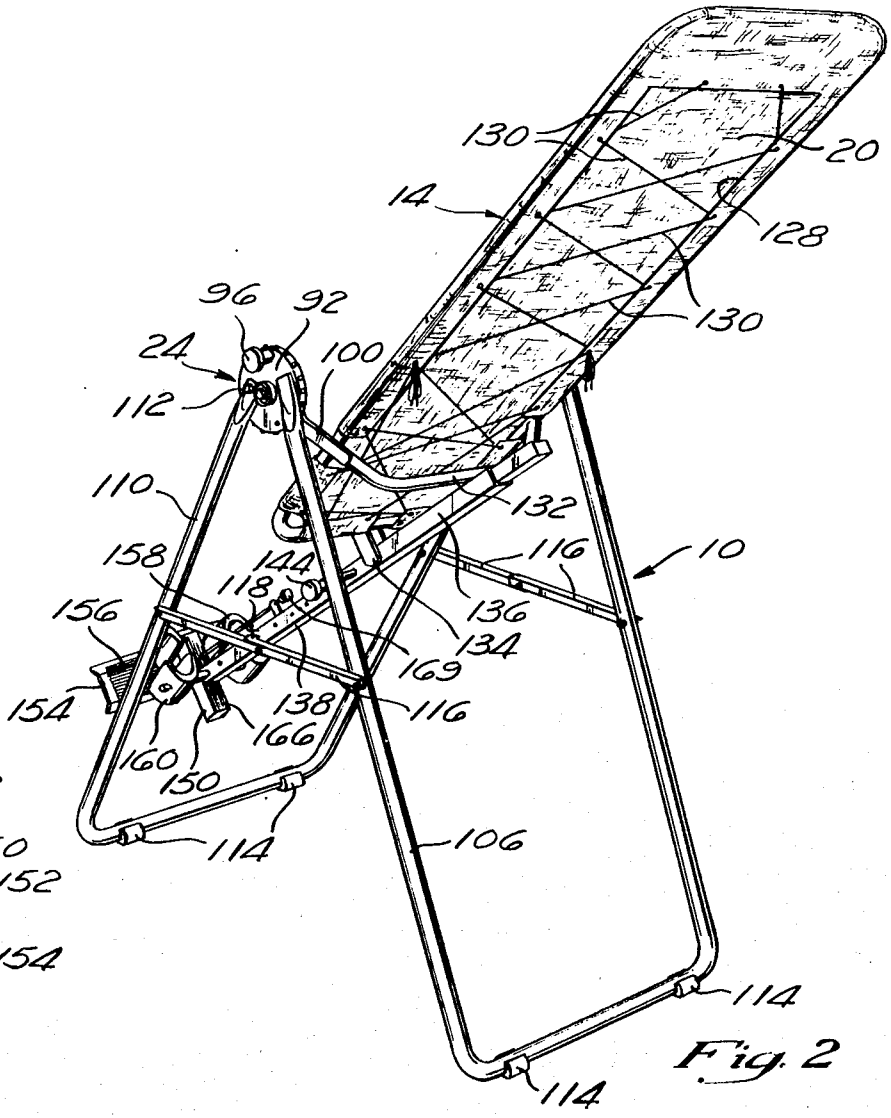
FIG. 2 is a reverse perspective view.
Figure 1:
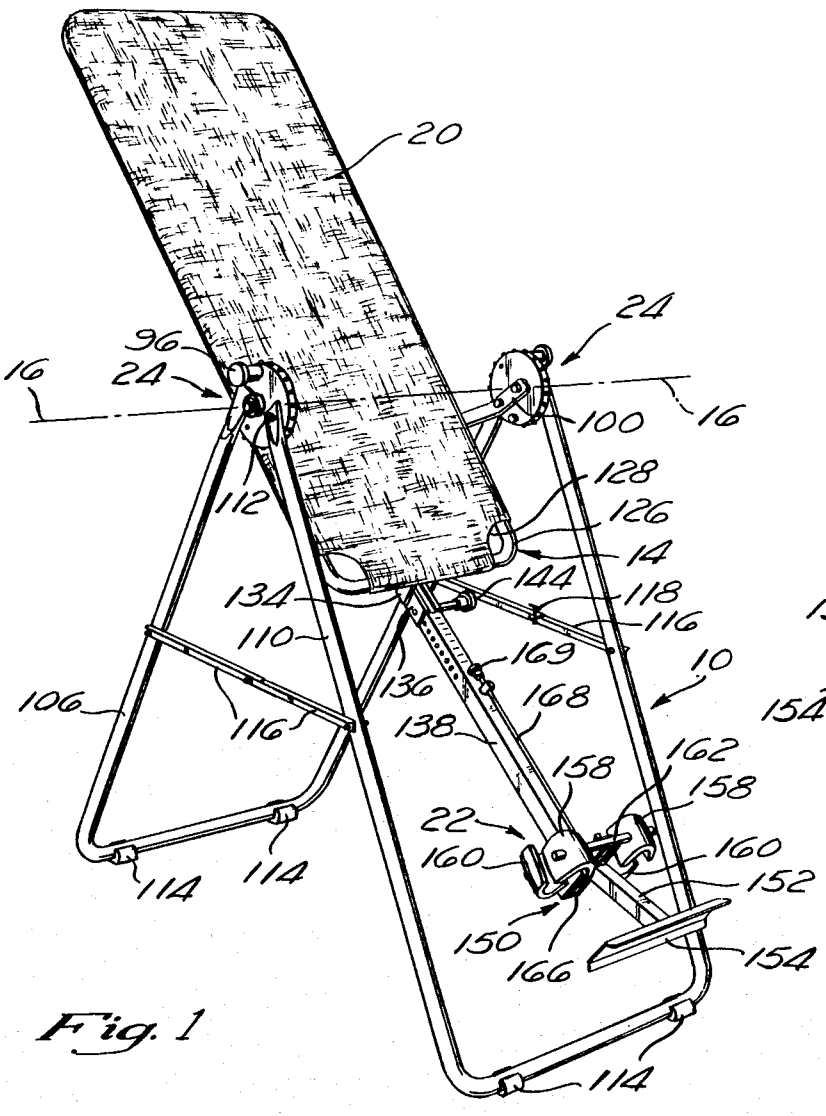
FIG. 1 is a perspective view of a specific embodiment of my new gymnastic equipment.
Figure 3:
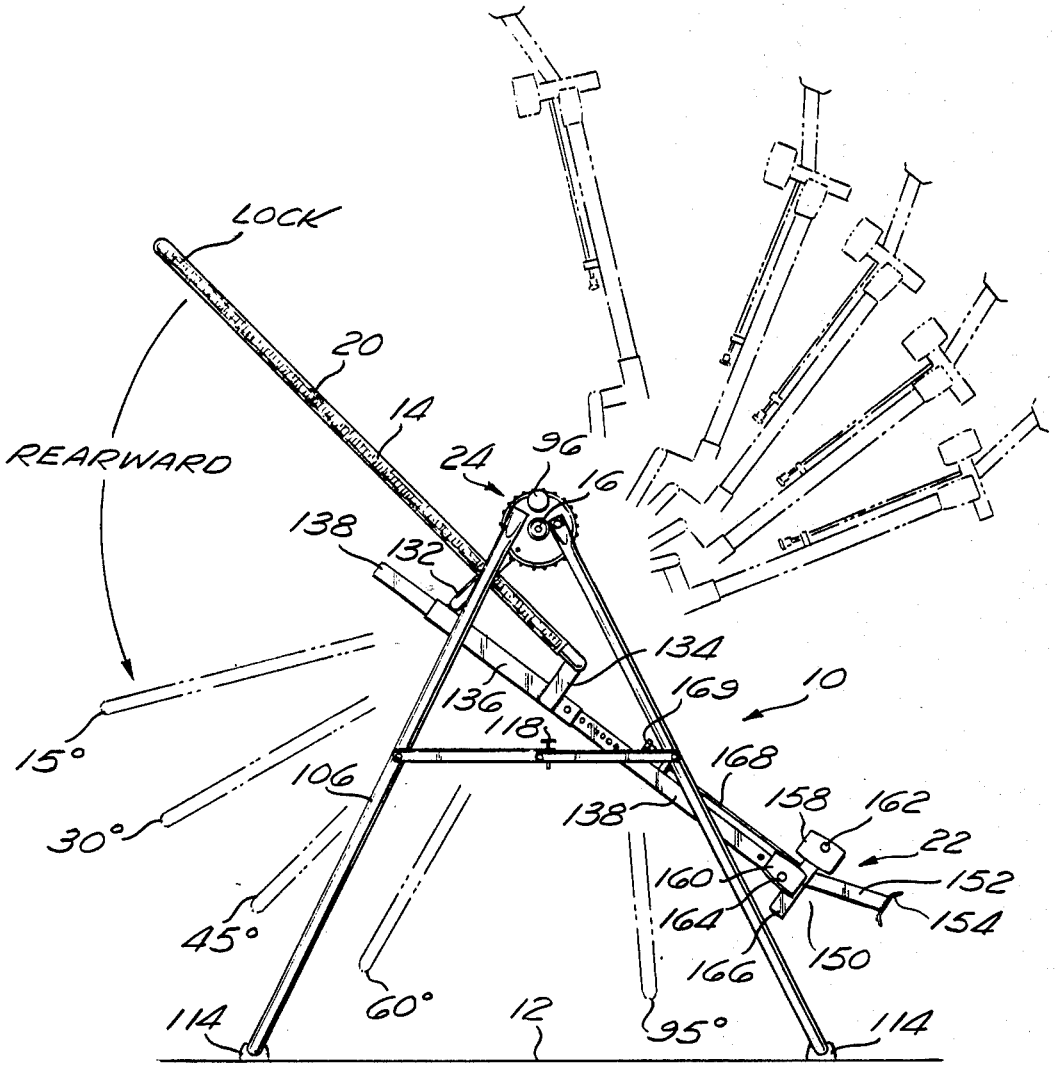
FIG. 3 is a side view. Alternative positions of the bed are shown in phantom.

My invention concerns a type of gymnastic equipment in which a first equipment-supporting frame 10, resting on the floor 12, pivotally supports a second user-supporting frame 14 to pivot about a horizontal pivot axis 16. Second frame 14 has a generally planar body-supporting bed 20 and has foot-engaging means 22 on a boom 138 at an end of bed 20. Foot-engaging means 22 is operable to support, by the user's feet, part or all of the user's weight in various pivotally adjusted normal and inverted positions.

Controls on Tilting of Bed 20

I will first describe the bed tilting controls 24 upon pivoting of bed 20. The controls shown include a series of juxtaposed generally circular plates substantially centered on pivot axis 16 and disposed in vertical planes extending laterally of axis 16. As shown, I prefer to provide duplicate controls 24 on both sides of the frames 10, 14, for positive latching and control of both sides of bed 20. However, the two sets of controls 24 are redundant and a single set of controls 24 would accomplish the control function by itself. Even with two control sets 24, the user could choose to set the controls 24 on only one side. Therefore, I will described controls 24 in terms of a single set of plates.

Each set of plates include, fundamentally, an outer plate 30, an intermediate plate 32 and an inner plate 34. Outer plate 30 is fixedly secured to first frame 10. Outer plate 30 supports a locking pin 40 slidably supported in a housing 42, shown as located at the top of the assembly, on the vertical axis 44.

Intermediate plate 32 has a series of locking openings 46 labeled as "15°", "30°", "45°", "60°", "95°", and "Lock". Openings 46 are spaced the same distance from pivot axis 16 as locking pin 40, so that pin 40 can be selectively positioned in openings 46 to lock intermediate plate 32 to outer plate 30 in various positions controlling the tilting of bed 20.

Inner plate 34 has secured thereto an outwardly extending abutment pin 50 mating with arcuate slots 52, 54 respectively in intermediate plate 32 and outer plate 30. The arcs of slots 52, 54 are centered on pivot axis 16 and are the same distance from axis 16 as abutment pin 50. Slots 52 are shown as having the same arcuate length. These slots limit tilting of bed 20 as set forth below.

Axis 56 shown on inner plate 34 is parallel to the plane of bed 20. Inner plate 34 is connected to bed 20 so that they will pivot together. Limitation on pivoting of inner plate 34, by the action of abutment pin 50 in arcuate slots 52, 54, will likewise limit the pivoting of bed 20.

Figures 4, 5:
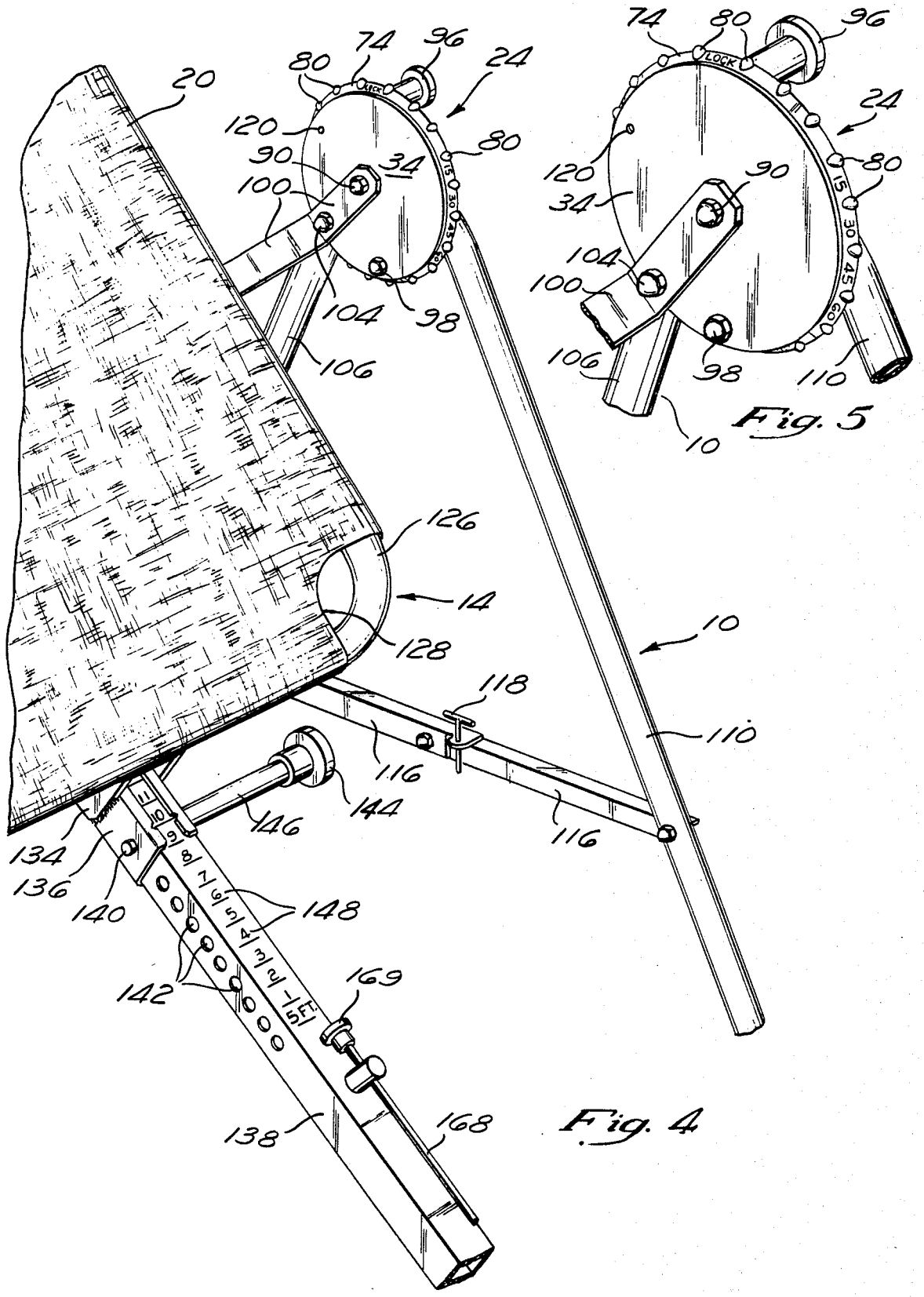
FIG. 4 is an enlarged partial perspective.
FIG. 5 is a partial perspective further enlarged.
Figure 6:
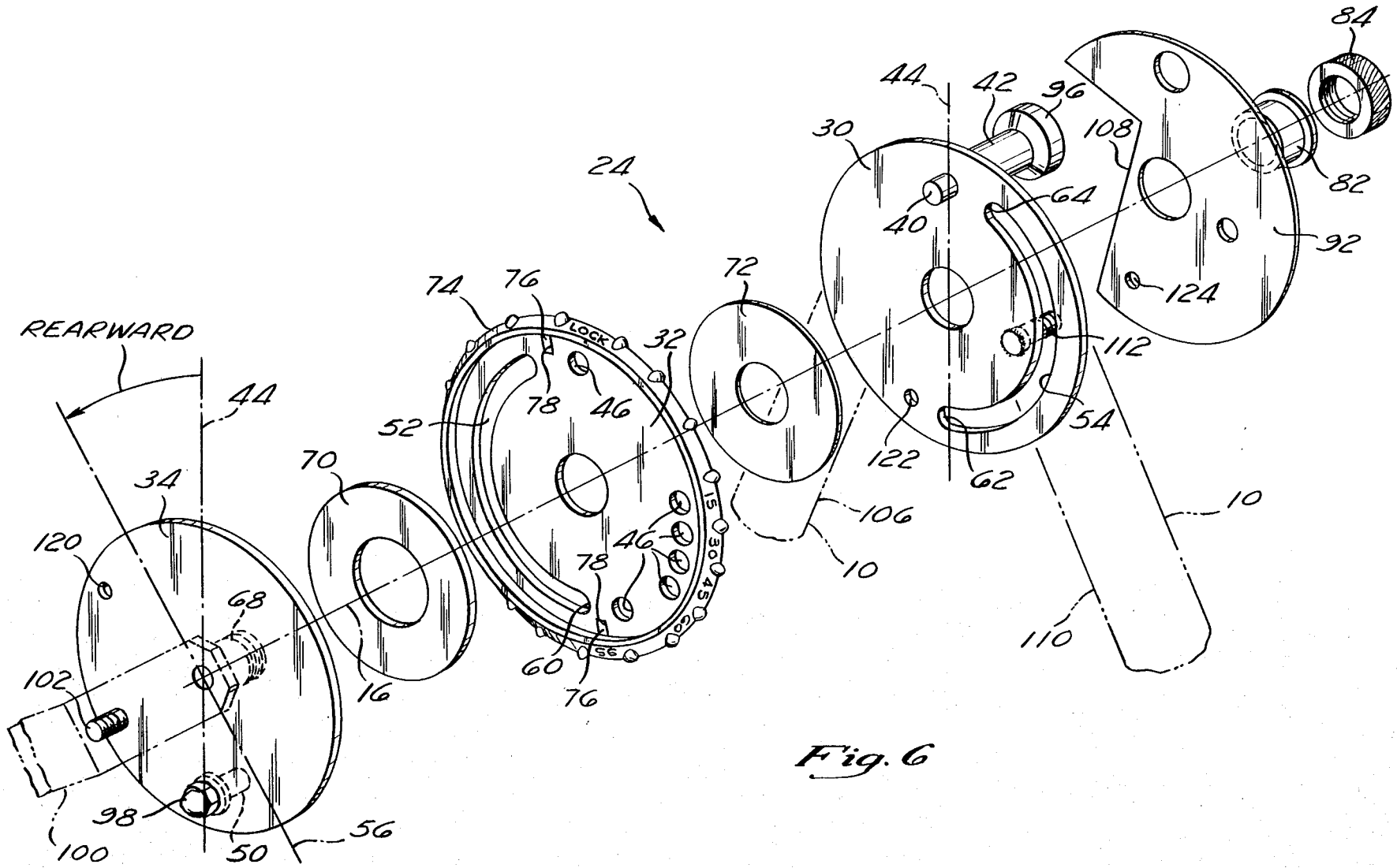
FIG. 6 is an enlarged exploded perspective view of the bed pivot control mechanism.
Figure 7:
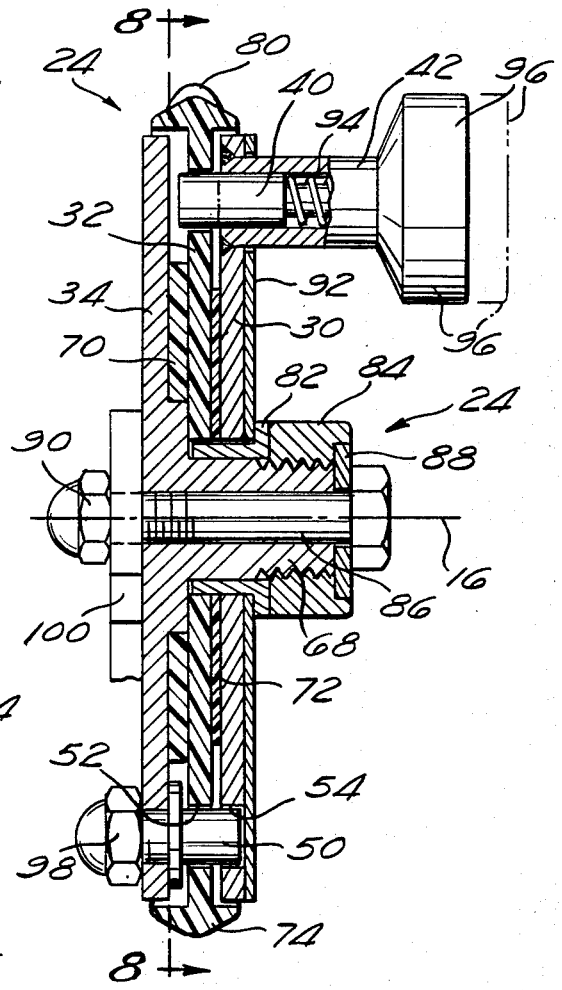
FIG. 7 is an enlarged end view, partly in section, of the bed pivot control mechanism.
Figure 8:
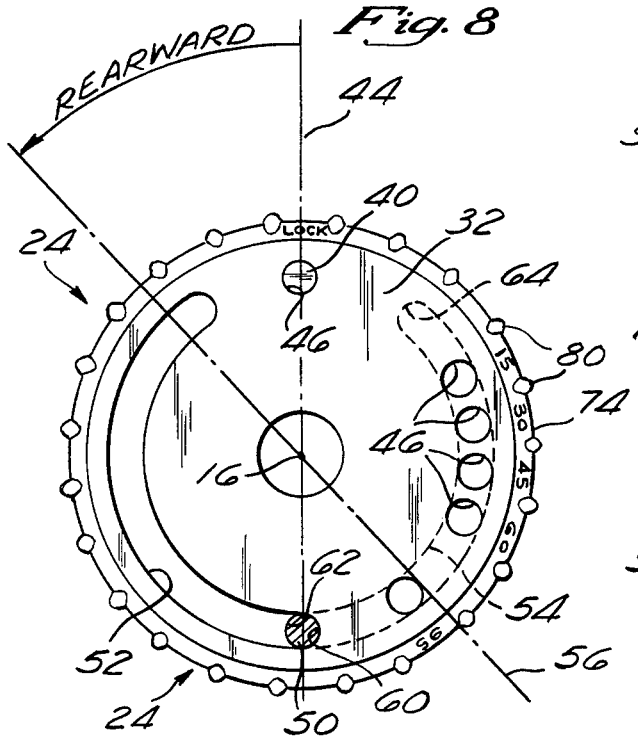
FIGS. 8, 9, 10, 11 and 12 are side views of the intermediate plate and control ring settings of "Lock", "15°", "45°", "60°", and "95°".

Referring to FIG. 8, when locking pin 40 is inserted into the locking opening 46 in plate 32 marked "Lock", slots 52, 54 only overlap sufficiently to accommodate abutment pin 50 and bed 20 is locked in a position in which the head of bed 20 is tilted back 45° from the vertical. The locked position is also depicted in FIGS. 4, 5, and 6. The locked position is to be contrasted to the other settings, i.e., 15° to 95°, when the bed 20 can be freely pivoted by shifting of the weight of the user from the forward position 45° back of vertical in which position the user mounts the apparatus, i.e., FIG. 8, and the reclined position 15° to 95° rearward and below horizontal, i.e., FIG. 9.

Figure 9:
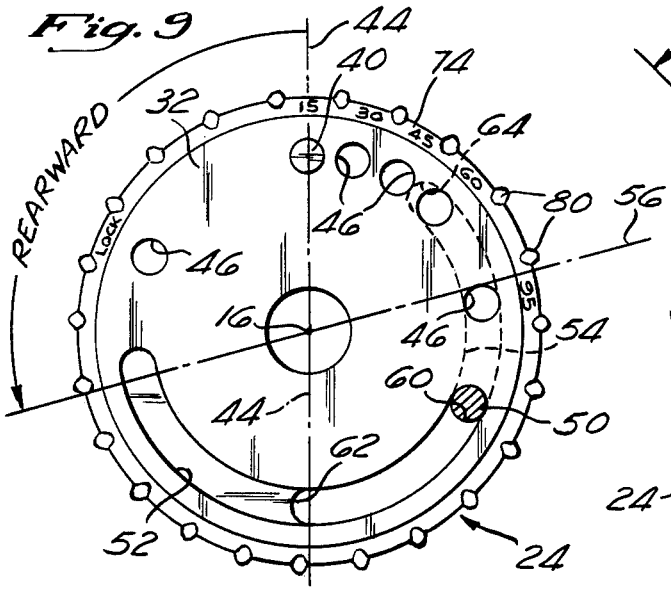
Figure 10:
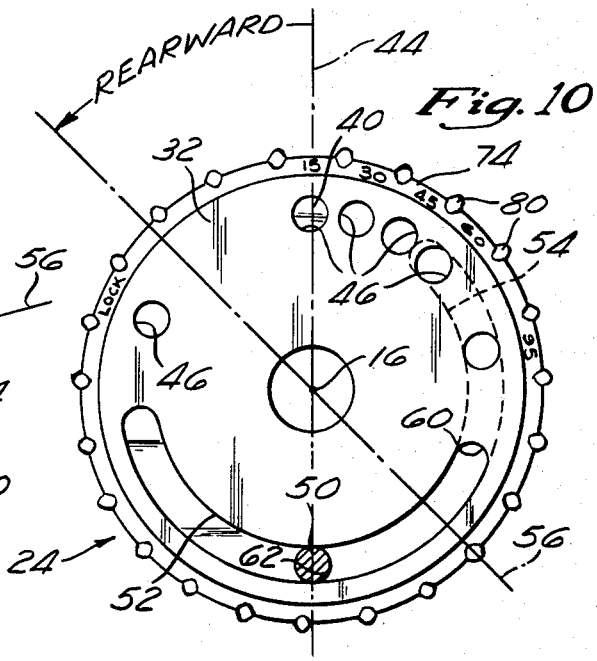

Referring to FIGS. 9 and 10, when locking pin 40 is inserted into the locking opening 46 in plate 32 marked "15°", the head of bed 20 (as represented by axis 56 on inner plate 34) can be tilted back from a forward mounting position shown in FIG. 10 tilted back 45° from the vertical to a reclining position shown in FIG. 9 tilted back 15° below horizontal. This backwards tilting (FIG. 9) is limited by the end 60 of arcuate slot 52 in intermediate plate 32. If the user wants to forwardly tilt the head of bed 20 (FIG. 10), the bed can pivot to a position 45° short of vertical, as limited by end 62 of slot 54 in outer plate 30. The travel of bed 20 between head forward and head rearward position is 60°. When the weight of the user is generally balanced about pivot axis 16 on bed 20 and foot supporting means 22, the user can pivot the bed through this 60° arc by slight shifting of the user's weight relative to axis 16.

When locking pin 40 is inserted into the locking opening 46 in plate 32 marked "30°", the head of bed 20 (as represented by axis 56 on inner plate 34) can be tilted back to a position 30° below horizontal. Backwards tilting is limited by end 60 of slot 52 in plate 32 and forward tilting is limited to 45° short of vertical by end 62 of slot 54 in plate 30. The limit of pivotal travel of bed 20 is 75° in the "30°" setting of controls 24.

When locking pin 40 is inserted into the locking opening 46 in plate 34 marked "45°", the head of bed 20 can be tilted backwardly to a position 45° below horizontal. The limits of pivoting by abutments 60 and 62 are 45° below horizontal and 45° above horizontal for a total of 90°.

Figure 11:
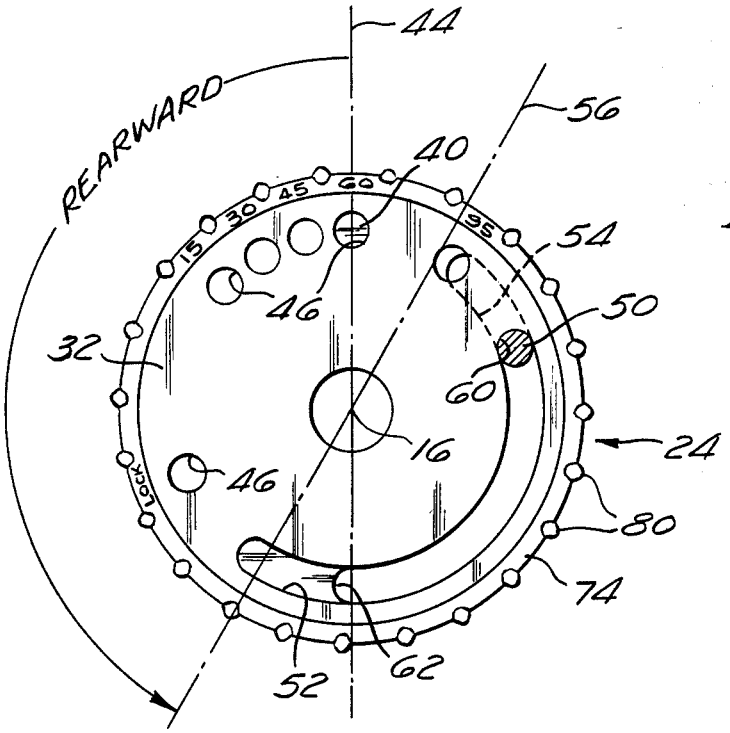

Referring to FIG. 11, when locking pin 40 is inserted into the locking opening 46 in plate 32 marked "60°", the head of bed 20 can be tilted backwardly to a position 60° below horizontal. The limits of pivoting of bed 20 by abutments 60 and 62 are 60° below horizontal and 45° above horizontal for a total of 105°.

Figure 12:
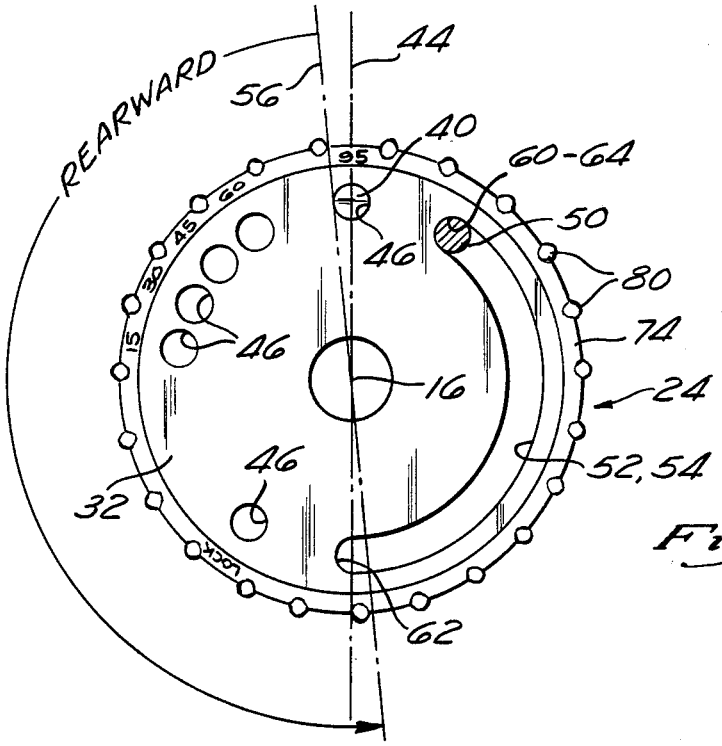
Figure 13:
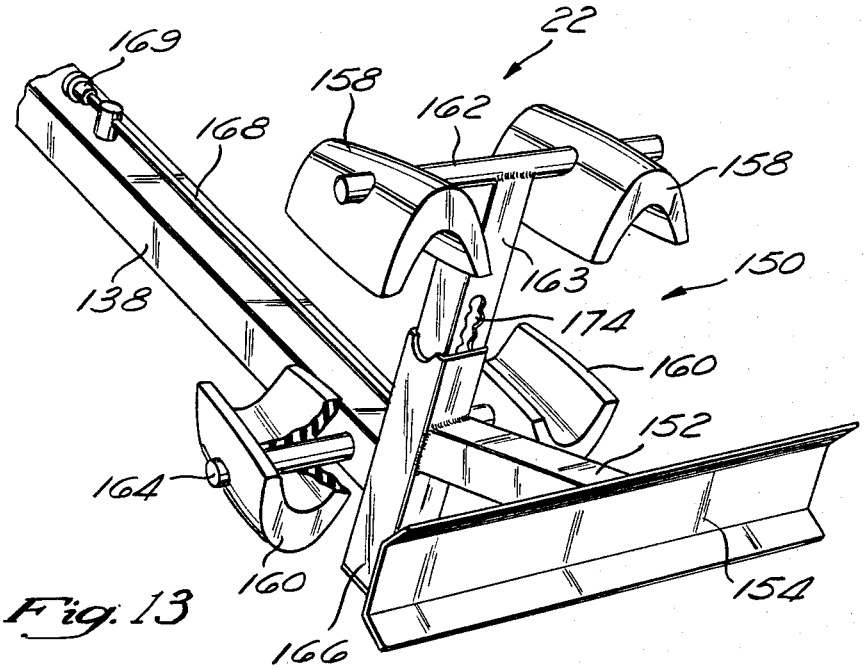
FIG. 13 is an enlarged partial perspective view of the foot-supporting portion of the equipment.

Referring to FIG. 12, when locking pin 40 is locked in the locking opening 46 marked "95°", the head of bed 20 can be tilted backwardly or rearwardly to the inverted position of 95° below the horizontal. The limits of pivoting of bed 20 by abutments 60 and 62 are 95° below horizontal and 45° above horizontal for a total of 140°. The limit of backwards pivoting of the head of bed 20 (to an inverted position) is also stopped by abutment of pin 50 to the other end 64 of slot 54 in outer plate 30. In order for both ends 62 and 64 in slot 54 in outer plate 30 to act as stops, the arcuate length should be 140°, which is limit of travel between stops 60, 62, given above for the locking opening 46 marked "95°".

The settings of pivoting of bed 20 may be tabulated as follows:

| Setting | Maximum Bed Head Tilt Back Below Horizontal | Maximum Bed Head Forward Tilt Back of Vertical | Total Bed Pivotal Travel |
|---|---|---|---|
| 15° | 15° | 45° | 60° |
| 30° | 30° | 45° | 75° |
| 45° | 45° | 45° | 90° |
| 60° | 60° | 45° | 105° |
| 95° | 95° | 45° | 140° |
| LOCK | (−)45° | 45° | zero |

Plates 30, 32, 34 are formed as circular bodies and are positioned respectively as outer, intermediate and inner members for reasons of convenience, appearance, etc. However, parts otherwise shaped or positioned could be functional. End 62 of slot 54 in outer plate 30 functionally acts as an abutment (to pin 50) limiting movement of the head of bed 20 in a forward pivoting movement to 45° back of vertical. As slot 52 is part of intermediate plate 32, when intermediate plate 32 is selectively fixed in positon relative to outer plate 30 and relative to first frame 10 (by locking pin 40 in a locking opening 46), end 60 of slot 52 functionally acts as a limit (to pin 50) on pivoting of inner plate 34 and of bed 20 in a backwards movement of the head of the bed. With some loss of ease of operation, appearance, etc., intermediate plate 32 and outer plate 30 could be exchanged in positions, from an analytical viewpoint, because abutment pin 50, acting in slots 52, 54, does not "know" which plate is outside. From viewpoints of convenient access and operation and of avoiding obstructions extending inwardly of the plane of controls 24, locking pin 40 and housing 42 should extend outwardly of the plane of controls 24, which means plate 30 preferably should be on the outside of controls 24.

I will now describe some of the structural details of the controls assembly. Inner plate 34 has a spindle 68 extending outwardly upon which intermediate plate 32 and outer plate 30 are journaled. Plastic rings 70, 72 between plates 34, 32 and between plates 30, 32, respectively, provide light frictional drag in adjustment of position of intermediate plate 32. A molded black nylon dial 74 is bonded to the periphery of intermediate plate 32. Tongues 76 on dial 74 fit in grooves 78 in plate 32 to locate and help secure dial 74 in place. The inscriptions "Lock", "15", "30", "45", "60", and "95" are molded in raised letters and numerals on dial 74. Lugs 80 on dial 74 may be grasped in turning plate 32.

The thickness tolerances of plate metal from which members 30, 32, 34 are formed are so large when obtained from regular commercial sources that I have compensated by use of plastic rings 70, 72, by use of a brass bushing 82, and by a knurled spindle nut 84. When nut 84 is properly tensioned so that intermediate plate 32 can be rotated with a suitable amount of play/friction, nut 84 is secured in position by bolt 86 extending through the center of spindle 68, by washer 88 and by acorn locknut 90. Cover plate 92 shields slot 54 in outer plate 30.

Locking pin 40 is slidable in housing 42 and is normally pressed to an inner locked position by compression spring 94. A knob 96 connected to pin 40 is outwardly pulled to release intermediate plate 32 during change of position of locking pin 40 from one opening 46 in plate 32 to another by rotation of dial 84. Abutment pin 50 is secured to plate 34 with an acorn lock nut 98. Bed 20 is secured to inner plate 34 by a flange 100 on bed 20 secured by lock nut 90 and bolt 86 and by another bolt 102 secured to inner plated 34 and another acorn lock nut 104.

Frame 10 has a fixed U-shaped leg 106 having its ends welded to outer plates 30. Cover 92 is recessed at 108 around leg 106. Frame 10 also has a pivotal U-shaped leg 110 with ends pivotally connected to outer plates 30 by bolts 112. Legs 106, 110 have rubber feet 114. Pivotally connected pairs of links 116 hold legs 106, 110 apart in operating position of the equipment. A lock pin 118 is stowed in an opening in one pair of links 116. Links 116 can be folded for storage or transportation of the equipment. Lock pin 118 can be used to lock the equipment in stored position, i.e., dials 74 are positioned in the "60° position at which point openings 120, 122, 124 in plates 34, 30 and cover 92 are aligned and lock pin 118 can be positioned therein. Note there are no lateral bracing impediments or obstacles between the legs of the U-shaped frame members 106, 110 to interfere with or injure the user.

Bed

Bed 20 has a tubular weldment making a frame 126 and a cover 128 that is stretched over frame 126 with cords 130.

The foot-engaging means 22 part of user-supporting frame 14 is secured to bed 20 by a bowed tubular member 132 and by a forked member 134 secured to a hollow housing 136 of rectangular cross-section. A boom 138 is slidably positioned in hollow housing 136 and is adjustably locked in position by a pin 140 extending through openings 142 in boom 138. A knob 144 is attached to pin 140 which is slidable and spring-pressed in a housing 146. A general indication of the proper setting of pin 140 in one of openings 142 is provided by the user height scale 148 on the face of boom 138, i.e., the user height scale shown starts at five feet and has settings every inch upwardly. The proper setting for a particular person is actually influenced by weight distribution as well as by height, so a user may find that pin 140 should be positioned in an opening 142 or two off the reading for the user's true height.

A footholder weldment 150 is secured to boom 138 including a diagonally disposed arm 152, a piece of metal shaped as a foot stand 154 at the end of member 152, and a rubber pad 156 on stand 154. A pair of upper rubber ankle pads 158 and a pair of lower rubber ankle pads 160 fit on top and bottom of the ankles and are supported respectively on tubes 162, 164 extending laterally of footholder 150. Tube 162 is secured to a traveler 163 sliding in and out of a housing 166 and normally spring-pressed to a position bringing upper pads 158 down toward lower pads 160. The traveler is secured in position by a push rod 168 selectively engaging traveler 163. Rod 168 has an upper knob 169 disposed between the legs of the user in a handy position for manipulation of the user. Push rod 168 is normally spring pressed to locked position and is released by pushing so that the pads 158, 160 can be adjusted in distance to fit the ankles of the user or to release the user's ankles when the user wants to dismount.

Figure 14:
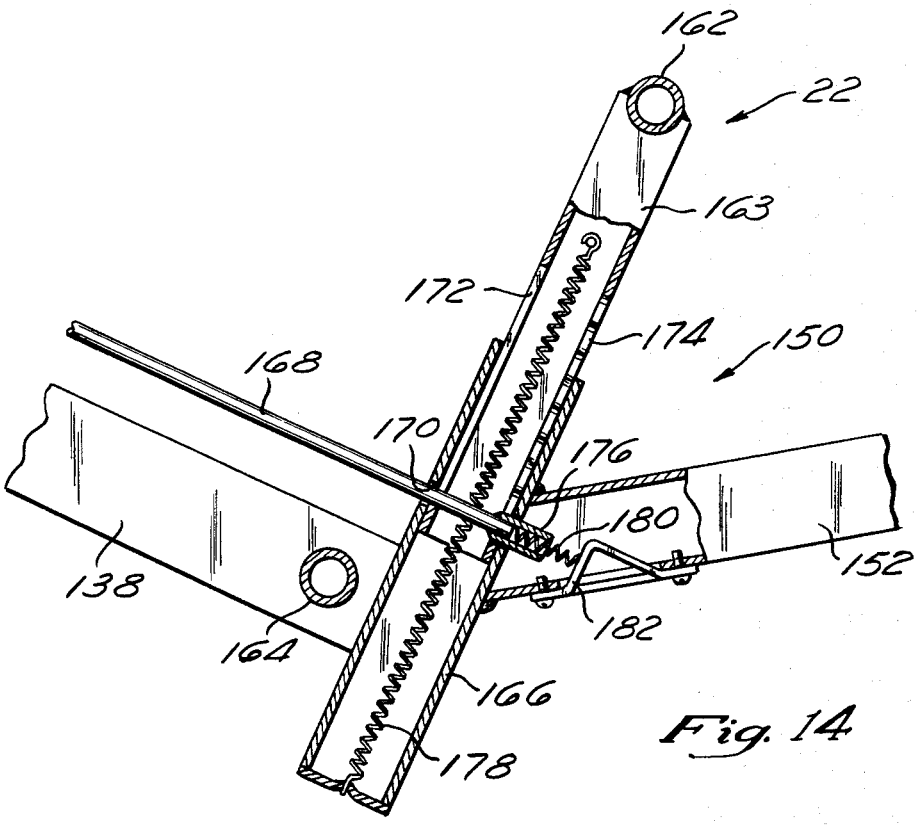
FIG. 14 is an enlarged partial side view, partly in section, of portions of the structure viewed in FIG. 13.

When the user is tipped back below horizontal in the 15°, 30°, 45°, 60° and 95° positions, the user will be supported by the ankles via pads 158, 160 to tubes 162, 164 and to the footholder and boom weldment. When the user is not tipped below horizontal, the user's feet by force of gravity will rest on foot stand 154. Push rod 168 extends through an opening 170 in housing 166, through a slot 172 in one wall of traveler 163 and through a serrated slot 174 in another wall of traveler 163. The latching end 176 of push rods 168 is formed by a sleeve adapted to selectively engage the serrations of slot 174 to secure traveler 163 in position with pads 158, 160 engaging opposite sides of the user's ankles. Release of latching end 176 from serrations 174 is by pushing on rod 168, which is spring pressed against release, whereupon pads 158, 160 close. Basically, pads 158, 160 constitute padding and it is tubes 162, 164, extending through openings in pads 158, 160, that support the user's weight in bed positions rearward of the horizontal. Even if the spring on rod 168 were to break, gravity would hold latching end 176 of push rod 168 engaged in serrated slot 174 in inclined bed positions, so that the user would still have his ankles clamped by pads 158, 160 and tubes 162, 164. The spring normally biasing traveler 163 to an ankle-securing position is shown in FIG. 14 at 178. The spring 180 normally biasing sleeved latching end 176 of push rod 168 to latched position is shown bearing on a clip 182.

Having thus described my invention, I do not wish to be understood as limiting myself for the exact construction shown and described. Instead I wish to cover those modifications of my invention that will occur to those skilled in the art upon learning of my invention and which are within the proper scope thereof.

I claim:

1. The improvement in gymnastic equipment including a first equipment-supporting frame to rest on the floor and a second user-supporting frame mounted on said first frame to pivot about a horizontal pivotal axis, said second frame having a body-supporting bed and having foot-engaging means at an end of said bed, said foot-engaging means being operable to support, by the user's feet, part or all of the user's weight in various pivotally adjusted normal and inverted positions, comprising:

(a) inner, outer and intermediate circular abutting plates centered at said pivotal axis, said outer and intermediate plates having slots oriented on circular arcs in excess of 90° centered on said pivotal axis and registered throughout at least their major extents in one pivotal position thereof, and an outwardly extending abutment pin on said inner plate extending through said slots so that ends of said slots form limits on movement of said abutment pin, (b) said outer plate being secured to said first frame and said inner plate being secured to said second frame to pivot together, and (c) said intermediate plate having a series of locking openings disposed equidistant from said axis and said outer plate having a movable locking pin the same distance from said axis as said locking openings, said locking pin being selectively engageable in said locking openings to limit maximum backward tilting of said bed to substantially complete inversion and to limit forward tilting of said bed to less than the vertical.

2. The subject matter of claim 1 in which said locking openings include openings variously permitting the head of said bed to tilt backwardly below horizontal about 15°, 30°, 45°, 60° and 95° when engaged by said locking pin.

3. The subject matter of claim 2 in which there is a concentric plastic ring on said intermediate ring having indicia labeling said locking openings as to how far said bed will tilt backwardly when each locking opening is engaged by said locking pin.

4. The subject matter of claim 1 in which the action of said slots on said abutment pin permits the head of said bed to tilt forwardly about 45° above horizontal.

5. The subject matter of claim 1 in which said slots overlap only the width of said pin in one pivot locking position of said locking pin in one of said locking openings, thereby to prevent bed pivoting.

6. The subject matter of claim 1 in which said inner plate has an outwardly extending hub centered on said axis and in which said outer and intermediate plates have central openings fitting on said hub, the outer end of said hub being threaded and a nut secured thereon to retain said plates in juxtaposed positions.

7. The improvement in gymnastic equipment including a first equipment-supporting frame to rest on the floor and a second user-supporting frame mounted on said first frame to pivot about a horizontal pivotal axis, said second frame having a body-supporting bed and having foot-engaging means at an end of said bed, said foot-engaging means being operable to support, by the user's feet, part or all of the user's weight in various pivotally adjusted normal and inverted positions, comprising: first, second and third control means, said first control means having a series of engaging means spaced arcuately about said axis and said second control means having lock means selectively engageable with said engaging means whereby selective pivotal adjustment settings can be set into the control means, said first and second control means each having an abutment spaced from said axis and said third control means having a traveler equally spaced from said axis to engage with said abutments, one of said control means being secured to said first frame and another of said control means being secured to said second frame whereby the limits of pivoting of said second frame can be controlled by the stopping of said traveler by said abutments and whereby abutment location can be varied by said selective pivotal adjustment settings.

8. The subject matter of claim 7 in which said first, second and third control means includes first, second and third juxtaposed plates, respectively, disposed in planes at right angles to said axis.

9. The subject matter of claim 8 in which said first and second plates have slots oriented on circular arcs centered on said axis and registering throughout at least their major extents in one pivotal position thereof and ends of said slots forming said abutments and said traveler being located to travel in said slots.

10. The subject matter of claim 9 in which said traveler is a pin secured to said third plate and extending through said slots and in at least one pivotal adjustment setting said pin strikes an end of both slots.

11. The subject matter of claim 10 in which said second plate is secured to said first frame and said third plate is secured to said second frame.

12. The subject matter of claim 8 in which said plates are generally circular and said engaging means in said first plate is a series of locking openings disposed equidistant from said axis and edge indicia on said first plate identifying the pivotal adjustment setting of each locking opening.

13. The subject matter of claim 7 in which said first control means is a plate disposed in a plane at right angles to said axis.

14. The subject matter of claim 13 in which said engaging means is a series of locking openings in said plate disposed equidistant from said axis for the purpose of permitting the head of said bed to tilt backwardly below horizontal to a selected variety of inclined positions.

15. The subject matter of claim 14 in which said locking openings include openings variously permitting the head of said bed to tilt backwardly below horizontal about 15°, 30°, 45°, 60° and 95° when engaged by said lock means.

16. The subject matter of claim 15 in which said abutments permit the head of said bed to tilt forwardly to a position above horizontal suitable for user mounting and dismounting relative to said second frame.

17. The subject matter of claim 14 in which said locking openings include a pivot lock opening in which position, when engaged by said lock means, said abutments are spaced apart only the width of said traveler thereby preventing pivoting of said second frame.

18. The subject matter of claim 17 in which said first and second control means have slots oriented on circular arcs centered on said axis and in which ends of said slots forming said abutments, said slots overlapping only the width of said traveler when said pivot lock opening is engaged by said lock means.

19. The subject matter of claim 14 in which said second control means is a second plate juxtaposed to the first plate forming said first control means, said second plate being disposed outside of said first plate, said second plate having an outwardly protruding pin housing which slidably supports a lock pin forming said lock means which has spring means normally pressing said lock pin into engagement in said locking openings and said lock pin having a knob on its outer end for withdrawal of the lock pin from an engaged locking opening.

20. The subject matter of claim 19 in which said first and second plates have slots oriented on circular arcs centered on said axis and ends of said slots form said abutments.

21. The subject matter of claim 20 in which said third contol means is a third plate juxtaposed to the other plates and disposed on the inside of said first plate and an outwardly extending pin secured to said third plate and disposed in said slots and forming said traveler, said third plate being secured to said second frame and said second plate being secured to said first frame.

22. The subject matter of claim 21 in which said third plate has an outwardly extending hub centered on said axis and said first and second plates have central openings fitting on said hub, the outer end of said hub being threaded and a nut secured thereon to retain said plates in juxtaposed positions.

23. The subject matter of claim 21 in which said plates are circular and said first plate having indicia on its edge labeling said locking openings as to how far said bed will tilt backwardly when each locking opening is engaged by said lock pin.

24. The subject matter of claim 23 in which there is a concentric plastic ring on said first plate including at least one axially directed lug disposed in a matching edge recess in said first plate to hold said ring in indexed position and said ring bearing said indicia.

25. The subject matter of claim 20 in which there is a cover plate on the outside of said second plate covering the slot therein for user protection.

26. The improvement in gymnastic equipment including a first equipment-supporting frame to rest on the floor and a second user-supporting frame mounted on said first frame to pivot about a horizontal pivotal axis, said second frame having a body-supporting bed and having foot-engaging means at an end of said bed, said foot-engaging means being operable to support, by the user's feet, part or all of the user's weight in various pivotally adjusted normal and inverted positions, comprising:

(a) said foot-engaging means including a boom extending from said bed, (b) a housing at the end of said boom extending laterally of said boom and a traveler slidably disposed in said housing to move laterally of said boom, (c) a pair of ankle-supporting members secured to said boom and a pair of ankle-supporting members secured to said traveler so said ankle-supporting members can be moved towards and away from each other in securement and release of ankles and said traveler having spring means normally biasing it toward ankles securing position, (d) latch means operative to latch said traveler relative to said housing in manually selected position, and (e) said latch means including an operating push rod extending along said boom and said push rod having a knob at its upper end to be located between the legs of users in position to be manipulated while users are reclining on said bed.

27. The subject of claim 26 in which said housing has an opening said rod extends through and said rod has a lower enlarged end and said traveler has a serrated slot which said enlarged end of said rod engages in latching said traveler and spring means normally biasing said rod to latched position and said rod unlatching by pushing action on said knob.

28. The improvement in gymnastic equipment including a first equipment supporting frame to rest on the floor and a second user-supporting frame mounted on said first frame to pivot about a horizontal pivotal axis, said second frame having a body supporting bed and having foot-engaging means at an end of said bed, said foot-engaging means being operable to support, by the user's feet, part or all of the user's weight in various pivotally adjusted normal and inverted positions, comprising:

a hub pivotal control centered at said horizontal pivotal axis which extends through a hub and having a stop and first and second abutments located at said hub and spaced closely to said axis at the same radial distance therefrom so that during pivoting of said second frame said stop and abutments have relative arcuate movement from a first position in which said stop abuts said first abutment and the head of the bed is above a horizontal plane including said axis to a second position in which said stop abuts said second abutment and the head of the bed is below said horizontal plane, said abutments and stop of said hub pivotal control being arcuately adjustable by user manual control relative to one another about said axis so that said stop and abutments have different lengths of arcuate travel between said first and second positions so that the head of the bed can pivot to various user selected levels below said horizontal plane in said second position.

* * * * *